US006983556B2

(12) United States Patent
McMullin

(10) Patent No.: US 6,983,556 B2
(45) Date of Patent: Jan. 10, 2006

(54) QUICK RELEASE SHOE CLEAT

(75) Inventor: Faris W. McMullin, Boise, ID (US)

(73) Assignee: Softspikes, LLC, Gaithersburg, MD (US)

( * ) Notice: Subject to any disclaimer, the term of this patent is extended or adjusted under 35 U.S.C. 154(b) by 155 days.

(21) Appl. No.: 10/638,465

(22) Filed: Aug. 12, 2003

(65) Prior Publication Data

US 2004/0079001 A1 Apr. 29, 2004

Related U.S. Application Data

(60) Provisional application No. 60/403,071, filed on Aug. 12, 2002.

(51) Int. Cl.
*A43C 15/00* (2006.01)
*A43C 15/16* (2006.01)

(52) U.S. Cl. ..... 36/67 R; 36/67 D; 36/134; 36/59 B

(58) Field of Classification Search ..... 36/67 R, 36/67 A, 67 D, 59 B, 62, 134
See application file for complete search history.

(56) References Cited

U.S. PATENT DOCUMENTS

| | | | | |
|---|---|---|---|---|
| 4,035,934 | A * | 7/1977 | Hrivnak | 36/67 D |
| 6,421,937 | B2 * | 7/2002 | Heller | 36/134 |
| 6,601,322 | B2 * | 8/2003 | Hsiao | 36/134 |
| 2001/0047599 | A1 * | 12/2001 | Heller | 36/134 |

FOREIGN PATENT DOCUMENTS

EP 346624 A2 * 12/1989

* cited by examiner

*Primary Examiner*—Anthony Stashick
(74) *Attorney, Agent, or Firm*—Edell, Shapiro, & Finnan, LLC

(57) ABSTRACT

A shoe cleat includes a cleat receiver with a cleat engaging section, a cleat including a receiver engaging section suitably dimensioned and configured to releasably engage with the cleat receiver, and a latch member suitably dimensioned and configured to releasably engage with the cleat engaging section and the receiver engaging section. When the cleat engaging section, the receiver engaging section and the latch member are engaged with each other, the cleat is releasably secured to the cleat receiver. Upon securing the cleat to the cleat receiver, the cleat is limited or substantially prevented from rotationally, laterally and axially moving with respect to the cleat receiver.

15 Claims, 8 Drawing Sheets

QUICK RELEASE SHOE CLEAT

CROSS-REFERENCE TO RELATED APPLICATIONS

This application claims priority from prior U.S. Provisional Patent Application Ser. No. 60/403,071, filed Aug. 12, 2002 and entitled "Quick Release Shoe Cleat". The disclosure of this application is incorporated herein by reference in its entirety.

BACKGROUND OF THE INVENTION

1. Field of the Invention

The present invention generally relates to shoe cleats, and more particularly to a quick release shoe cleat adaptable for quick replacement cleats of the same or different design.

2. Discussion of the Related Art

Many types of activities require walking, running or standing upon soft surfaces such as grass, sand or dirt. In order to obtain superior traction upon such surfaces, a variety of different types of cleats and other traction gaining devices have been developed. One type of traction gaining device is a shoe with traction studs or cleats molded or otherwise formed as a part of the shoe. One significant disadvantage to these types of shoes is that the cleats or studs wear down when the shoes are worn on a hard surface such as asphalt or concrete. Thus, in order to regain traction, the entire shoe must be replaced. This can be a costly and inconvenient undertaking. Likewise, when conditions require cleats having differing characteristics, such as cleat length or traction pattern, the person wearing the cleats cannot simply exchange the existing cleats on their feet with other cleats; rather, they must change shoes completely. This also can be inconvenient and potentially costly.

Another type of traction gaining device involves the use of cleats that are selectively attached to and removable from an athletic shoe. A wide variety of shoes and cleat attachment configurations exist. Many of the cleat attachment configurations are based upon a configuration wherein a socket receiver is attached to the sole of a shoe. The socket is configured for connection with a cleat having a ground surface contacting portion and a cleat post configured to be inserted within the socket. The socket is generally configured with a connection means such as a threaded coupling designed to combine with a compatibly configured cleat post. In use, the cleats are aligned with the socket and rotated so that the threads of the cleat post intermesh with the threaded portions of the socket thereby engaging and holding the cleat in a desired location within the socket.

While this method of connection is acceptable in many situations, it also has several drawbacks. First, the cleat posts can become loose through routine wear, causing a variety of problems, namely: the loose cleats can fall out of the socket and become lost; the loose cleats become positionally unstable and can cause injury; the loose cleats can also become broken or damaged. In addition, when the cleats are loose and come into contact with debris such as rocks, sand and gravel, those materials can scour the cleat threads, making it nearly impossible to tighten the cleat without damaging both the cleat post and the socket. Further, the loose cleats can be bent or broken as forces are applied to the cleats which are greater than the capacity of the cleats to withstand.

In order to prevent or limit the loosening or loss of the cleats, in many instances tools are required to tighten the cleats into the sockets and likewise to remove the cleats from the sockets. In utilizing these cleat-tightening tools, the actual cleats can be broken by over tightening. Additionally, these tools may allow a party to score the threads of the cleat, thus making removal and replacement of the cleat very difficult. A common problem that occurs with such cleat types is that the tool is not necessarily available when it is needed, and therefore a party cannot replace a worn out, broken or undesired cleat.

Some cleat designs in the related art have modified the connection between a cleat and socket by modifying the threaded connection between the socket and the cleat post. This has been done in a variety of ways including adding various shapes to prevent unwanted rotation. While this may be effective in limiting the rotation of the cleat within the socket, many of these devices still require a specialized tool for their use and are subject to the above-described and other negative consequences that accompany the use of such tools. This removal and attachment process can also often be cumbersome and time consuming. This is generally not desired when a party seeks imminent participation in an activity.

Other types of cleat connecting mechanisms have also been developed wherein a latch or knob is biased by a spring. Generally, in order to place the cleat within the desired location, the latch or knob is depressed so that the spring is compressed. From this position, a portion of the cleat is inserted into a desired location and the compression tension on the spring is released. Many of these types of devices also require special tools to allow the cleat to be connected or disconnected from the shoe. In addition, elements such as water, sand and grit can cause damage to the spring, with the result that it becomes unable to either retract or expand. As a consequence, cleats may either fall out or be so tightly engaged that they cannot be removed without the use of tools.

Thus, a cleat design is desirable that facilitates easy and quick removal of a cleat from a shoe without the requirement of special tools, while ensuring the cleat remains firmly affixed to the shoe and does not become loose or reduce stability during use.

OBJECTS AND SUMMARY OF THE INVENTION

Accordingly, it is an object of the present invention, in recognition of the aforesaid problems, to provide a cleat attachment system and method that permit secure, tight-fitting cleat connections without the use of tools.

It is another object of the invention to provide connection device and method that do not require the use of springs.

A further object of the invention is to provide a cleat attachment system and method that provide secure tight-fitting cleat connections that are easily removable without the use of specialized tools.

The aforesaid objects are achieved individually and in combination, and it is not intended that the present invention be construed as requiring two or more of the objects to be combined unless expressly required by the claims attached hereto.

In accordance with the present invention, a shoe cleat assembly includes a cleat receiver including a cleat engaging section, a cleat including a receiver engaging section suitably dimensioned and configured to releasably engage with the cleat receiver, and a latch member suitably dimensioned and configured to releasably engage with the cleat engaging section and the receiver engaging section. Upon engagement of the cleat engaging section, the receiver engaging section and the latch member with each other, the cleat is releasably secured to the cleat receiver.

While there are a number of possible variations on the basic design of the present invention, the shoe cleat of the present invention is preferably formed of at least three components, namely a cleat, a cleat receiver and a latch clip or pin. The cleat receiver is formed of a base portion to which is attached and formed integral therewith some anchoring portion, such as a spoke and rib arrangement designed to be embedded in the outer sole of the shoe as the outer sole is formed or molded. The base portion preferably has preformed within it a socket that is configured to receive an attachment plug portion of the cleat. Alternatively, the cleat may include a socket and the cleat receiver an attachment plug portion. The socket preferably includes an anti-rotation receiver socket portion to engage or mate with an anti-rotation body of the attachment plug portion. A latch clip receiving slot is provided in communication with the socket to receive portions of the latch clip or pin. When the cleat and cleat receiver are engaged with each other such that the socket and attachment plug portions mate with each other, the latch clip or pin is inserted into the socket, via the receiving slot, to achieve a locking relationship with the cleat. In this locking relationship, the cleat is effectively limited or substantially prevented from axial, lateral and rotational movements with respect to the cleat receiver.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

Figure 1:
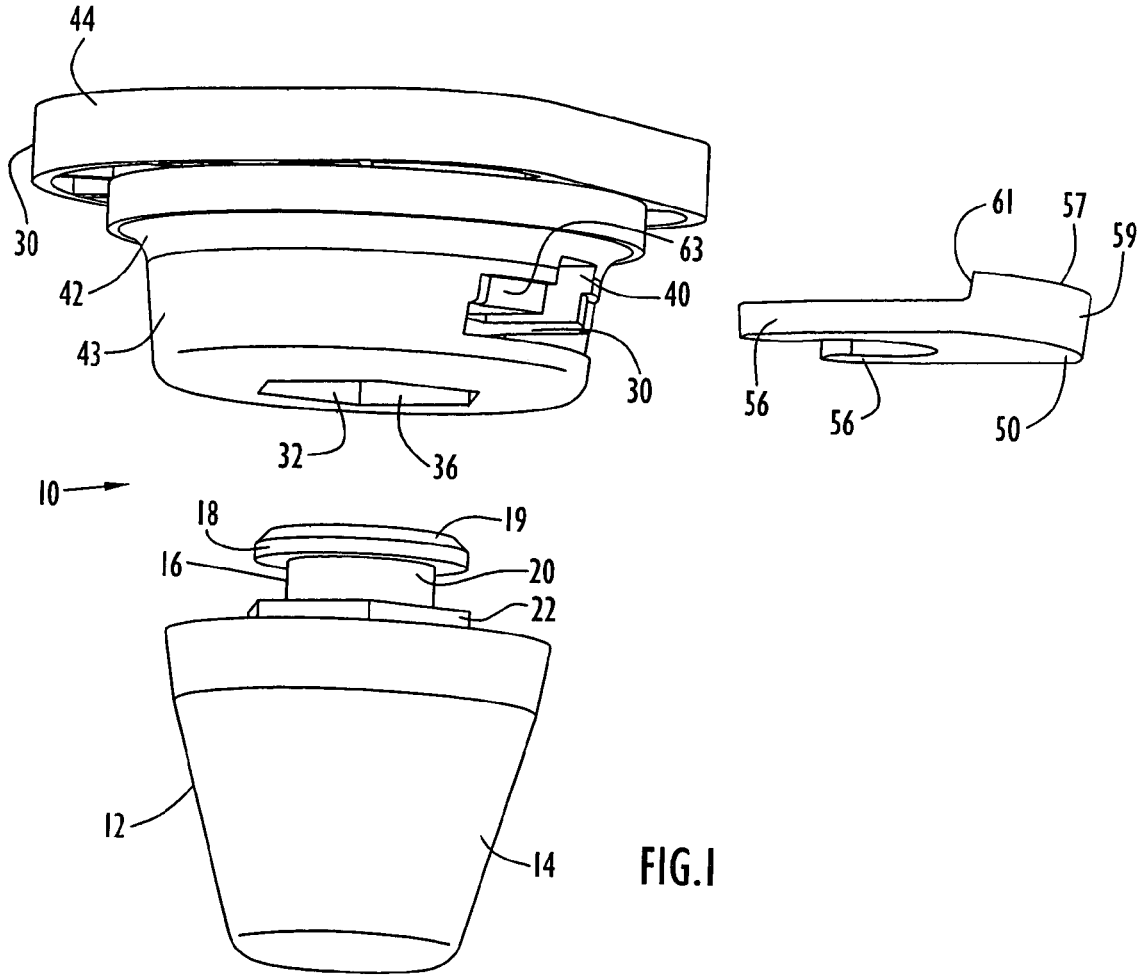
FIG. 1 is an exploded view in perspective of a first embodiment of the a cleat and socket arrangement according to the present invention.

While the invention is susceptible of various modifications and alternative constructions, certain illustrated embodiments thereof have been shown in the drawings and will be described below in detail. It should be understood, however, that there is no intention to limit the invention to the specific form disclosed; on the contrary, the scope of the invention covers all modifications, alternative constructions, and equivalents falling within the spirit and scope of the invention as defined in the claims.

Referring to FIGS. 1–7, there is shown a first embodiment of the quick release shoe cleat assembly 10 of the present invention. The cleat assembly is formed of three basic components, namely a cleat 12, a cleat receptacle or receiver 30, and a latch clip 50. Unless indicated otherwise, the components of the cleat assembly may be made of any suitable material including, without limitation, molded plastic, rubber and/or metal.

Referring specifically to FIGS. 1, 3A, 3B and 4, cleat receptacle 30 includes a base portion 42 to which is attached and formed integral therewith an anchor rim 44. Anchor rim 44 is connected to base portion 42 via a series of spokes or ribs 45 (FIG. 4) extending radially between an inner peripheral side surface of the rim and an outer peripheral side surface of the base portion. Anchor rim 44 is further designed to be embedded in the outer sole of a shoe as the outer sole is formed or molded. Base portion 42 includes a hollow and generally cylindrical section 43 that extends away from the rim and includes an axially extending socket 32. The socket extends to an end surface 46 of section 43 and is configured to receive an attachment plug portion 16 of cleat 12 as described below.

Socket 32 is formed of three different sections, each serving a separate function. Specifically, socket 32 includes an innermost section (i.e., the section of the socket that is close or nearly adjacent to anchor rim 44) that defines a retention ring receiver socket portion 34. The retention ring receiver socket portion is substantially smooth and concave and is complementary in shape with at least a portion of a plug retention ring 18 disposed on the cleat 12 as described below. The socket further includes an outermost section (i.e., the section of the socket that is furthest in distance from the anchor rim) that defines an anti-rotation receiver portion 36 extending to end surface 46 of cylindrical section 43. The anti-rotation receiver portion has a hexagonal configuration (i.e., a transverse cross-sectional geometry in the shape of a hexagon) that is sufficiently dimensioned to receive and mate with an anti-rotation body 22 of cleat 12 as described below. An intermediate section of socket 32, which lies between retention ring receiver socket portion 34 and anti-rotation receiver portion 36, is sufficiently dimensioned to receive portions of the cleat as well as portions of a latch clip 50 as described below.

An elongated latch clip receiving slot 38 is defined along a peripheral side surface between the longitudinal ends of the base portion cylindrical section 43. Slot 38 is oriented lengthwise on the cleat receiver in a direction transverse the longitudinal orientation of cylindrical section 43. The latch clip receiving slot communicates directly with the intermediate section of socket 32 and is sufficiently dimensioned to receive portions of latch clip 50 as described below. A generally rectangular access notch 40 extends from slot 38 and is sufficiently dimensioned to provide an insertion point for a finger or a prying tool to facilitate removal of latch clip 50 after the latch clip has been inserted and retained in slot 38 as described below. Any suitable prying tool may be utilized with the cleat assembly including, without limitation, a user's finger or thumb, a screwdriver, a paper clip, the tip of a pen or pencil, a utensil (e.g., a fork or knife), etc. Alternatively, shoe cleat assembly 10 may be provided with a specialized prying tool that is configured for use with the cleat and cleat receiver.

Figure 2A:
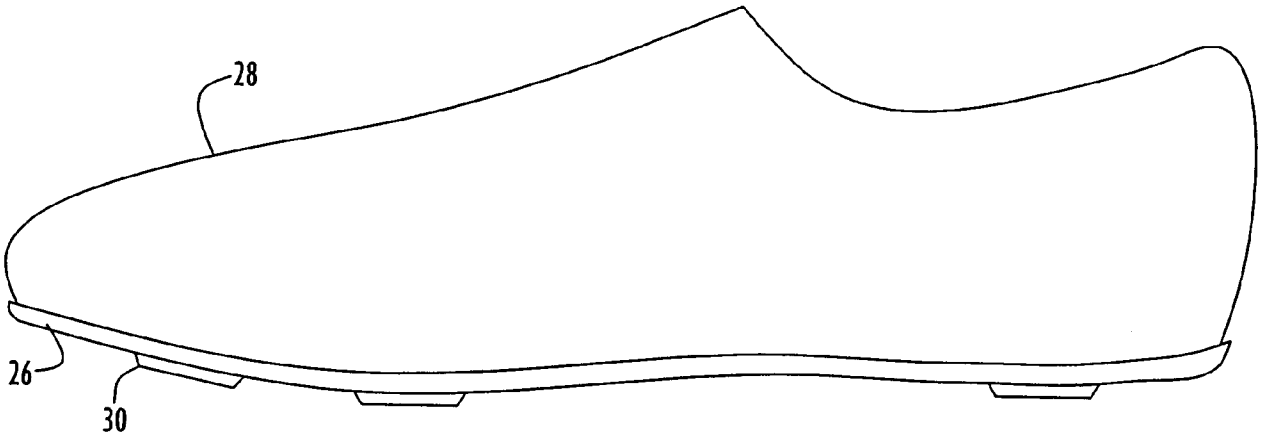
FIG. 2*a* is a side view in elevation of a shoe showing cleat receptacles depending from the shoe outsole.
Figure 2B:
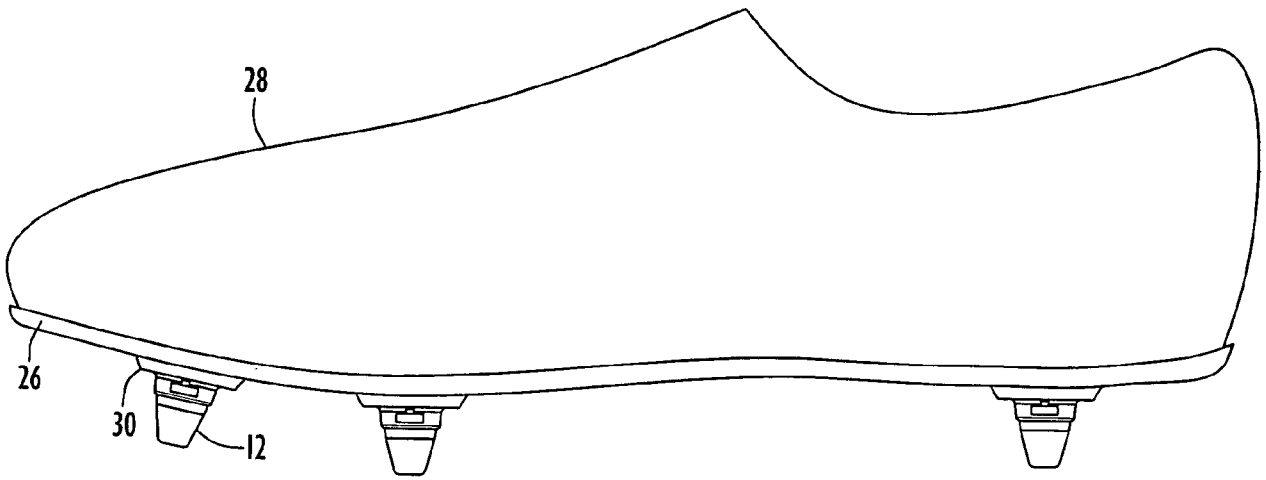
FIG. 2*b* is a side view in elevation of a shoe showing the shoe of FIG. 2*a* with cleats installed in the receptacles.
Figure 3A:
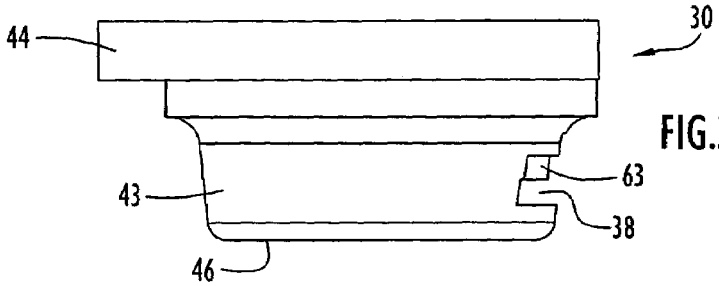
FIG. 3*a* is a side view in elevation of the cleat receptacle of the first embodiment.
Figure 3B:
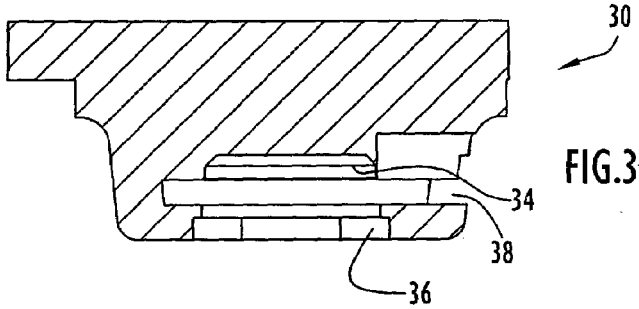
FIG. 3*b* is a detailed cross-sectional side view of the cleat receptacle of the first embodiment.
Figure 4:
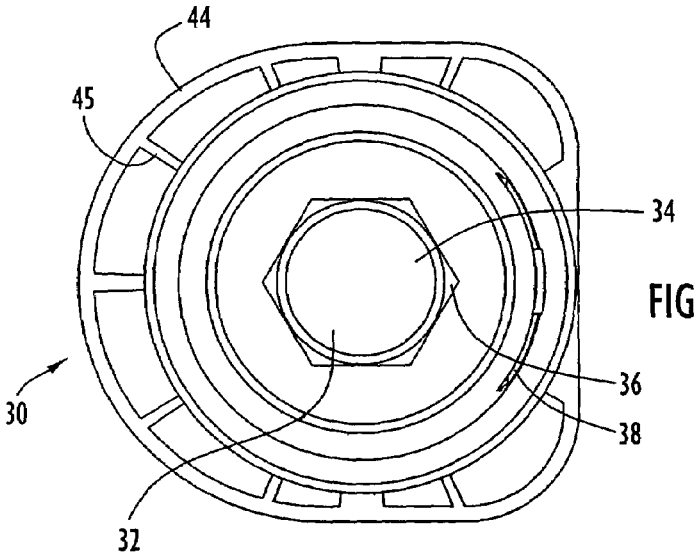
FIG. 4 is a top view in plan of the cleat receptacle of the first embodiment.

As shown in FIGS. 2A and 2B, cleat receiver 30 is designed to be at least partially embedded within the outer sole of a shoe. In particular, FIG. 2A illustrates a shoe 28 with cleat receivers 30 substantially embedded within the sole 26 but without any cleats attached to the cleat receivers, while FIG. 2B shows the same shoe 28 with cleats 12 connected to cleat receivers 30. This type of cleat attachment configuration is most easily adapted for use with footwear wherein the outer sole of the shoe is a molded piece.

Figure 5:
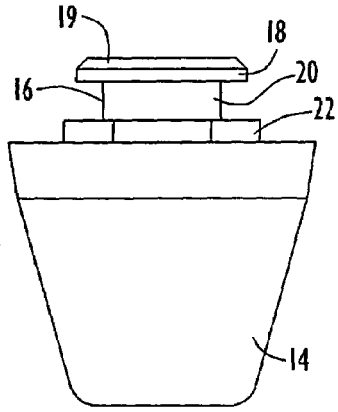
FIG. 5 is a side view in elevation of the cleat of the first embodiment.

Referring to FIGS. 1 and 5, cleat 12 includes a cleat element 14, depicted in the figures as a generally conical member with a truncated terminal end, and an attachment plug 16 extending from a base section of the cleat element and suitably dimensioned to be received within socket 32 of cleat receiver 30. While the cleat element is shown throughout the figures as a single ground engaging element having a conical shape, it is noted that this specific design is provided for illustrative purposes only and any selected type of cleat may be utilized with the present invention. For example, cleats may be utilized in accordance with the present invention that include any selected number of ground engaging elements having the same and/or varying dimensions, where the ground engaging elements may have any one or more selected geometric configurations and may further be arranged in any selected alignment (e.g., symmetrical or asymmetrical) with respect to each other and a base to which they are formed.

Attachment plug 16 includes three distinct portions, namely an anti-rotation body 22 extending directly from the base portion of cleat element 14, an intermediate elongated body portion 20 extending from the anti-rotation body, and a plug retention ring 18 extending from body portion 20 and defining the terminal end of the attachment plug. Plug retention ring 18 includes a rounded and tapered end portion 19 that is suitably dimensioned to complement and mate with retention ring receiver portion 34 of socket 32 when the attachment plug is fully inserted in the socket. Elongated body portion 20 is generally cylindrical and has a diameter that is smaller in dimension than the transverse dimensions of each of anti-rotation body 22 and plug retention ring 18. The anti-rotation body 22 of the attachment plug has a hexagonal configuration (i.e., a transverse cross-sectional geometry in the shape of a hexagon) that corresponds with and is slightly smaller in dimensions than anti-rotation receiver portion 36.

The dimensions of the socket sections and the cleat attachment plug sections are also preferably selected such that, when the attachment plug is fully inserted in the socket, plug retention ring 18 engages or mates with retention ring receiver socket portion 34, elongated body portion lies substantially within the intermediate section of the socket, and anti-rotation body 22 engages or mates with anti-rotation receiver portion 36. Accordingly, the complementary hexagonal shapes of the anti-rotation body and the anti-rotation receiver portion prevent inadvertent rotational and lateral (i.e., side-to-side) movements of the cleat with respect to the cleat receiver.

Further, it is noted that the complementary shapes for the anti-rotation body and the anti-rotation receiver are not limited to hexagonal configurations; rather, the complementary shapes may have any suitable geometric configurations including, without limitation, elliptical, triangular, square, trapezoidal, star shaped, and any other type of multi-faceted surfaces. In a like manner, a gear tooth arrangement with either horizontally and/or vertically oriented intermeshing teeth would also work equally well to prevent rotation. And also in a like manner, an anti-rotation design could include one or more posts with complementary receiving holes or slots disposed along the anti-rotation body and anti-rotation body receiver portions of the cleat and the cleat receiver (e.g., as depicted in FIGS. 9 and 11–13). Thus, the invention is not limited to a particular shape of the complementary anti-rotation body and receiver portions, but rather that the complementary shapes effectively prevent rotations and lateral movements of the cleat with respect to the cleat receiver when the cleat attachment plug is fully received and secured within the cleat receiver socket. In alternative embodiments (e.g., the embodiments of FIGS. 9 and 11–13), an anti-rotation feature can be integrated into other engaging sections of the cleat and cleat receiver to thereby reduce the number of distinct sections required to effectively secure the cleat to the cleat receiver.

Figure 6:
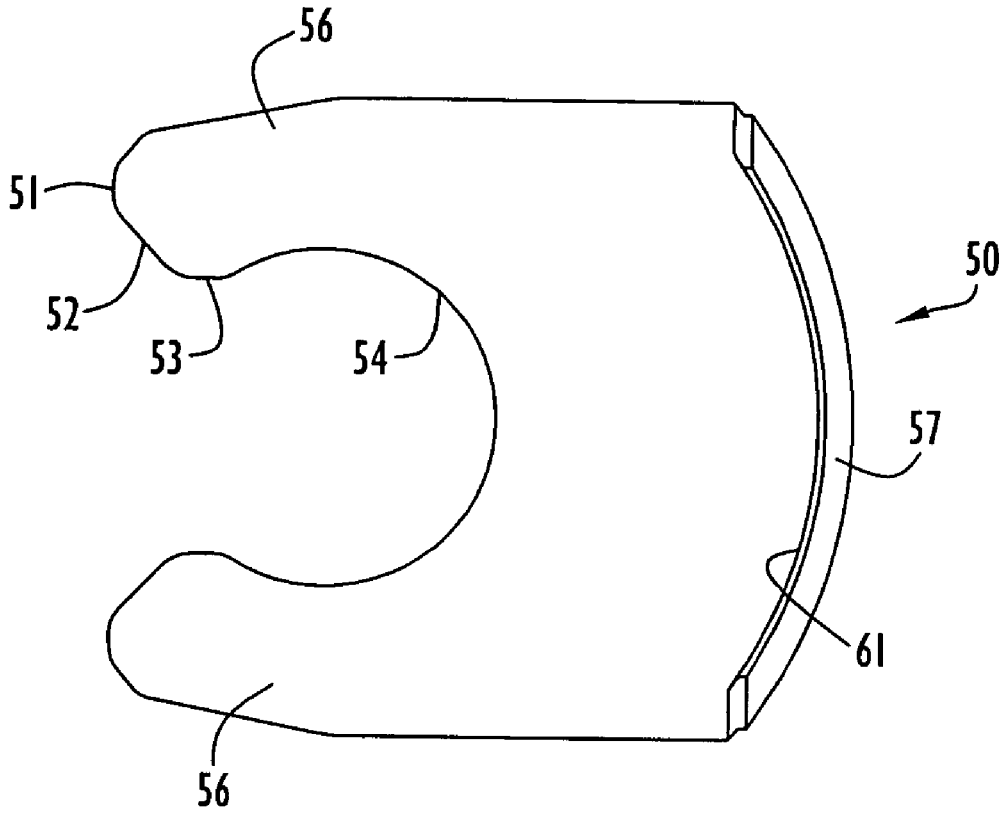
FIG. 6 is a top view in plan of the latch clip of the first embodiment.
Figure 7:
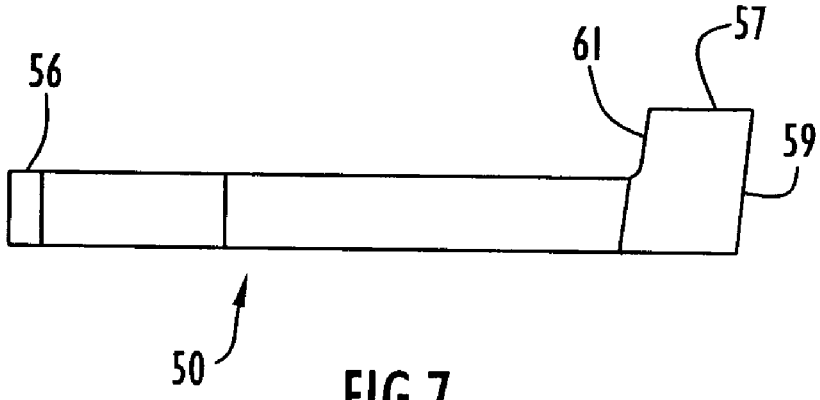
FIG. 7 is a side view in elevation of the latch clip of the first embodiment.

Referring to FIGS. 1, 6 and 7, a latch clip 50 is provided to releasably secure cleat attachment plug 16 within cleat retainer socket 32 as described below. Latch clip 50 has a generally U-shaped configuration and includes a pair of legs or prongs 56 extending from a base portion. The latch clip is formed of a resilient material having a sufficient strength and hardness to effectively secure the cleat to the cleat receiver while permitting resilient flexure of prongs 56 toward and/or away from each other in response to the application of a sufficient force applied to the prongs. Exemplary materials of construction for the latch clip include, without limitation, resilient metals (e.g., a spring steel), resilient plastics, rubber and other elastomeric materials.

The free ends of prongs 56 are generally rounded and extend slightly inward toward each other and in a direction transverse the major dimension of the clip, with a generally rounded interior cut-out section defined between the prongs that is slightly larger in dimension and complementary in shape to the transverse cross-sectional dimension of attachment plug body 20. In particular, the end portions of prongs 56 include end surfaces 51 that are generally coplanar with each other, angled side surfaces 52 that extend at an obtuse angle (e.g., 135°) from the end surfaces in a direction inward and toward each other, and side surfaces 53 that extend from the angled side surfaces and are generally parallel with each other. These end and side surfaces of the prongs are preferably adjoined at rounded edges to minimize any wear to the cleat attachment plug when plug body 20 engages with prongs 56. A smooth and rounded side surface 54 extends between both side surfaces 53 to form the inner side periphery of each of the prongs. When the clip is fully received with the cleat receiver in a locking relationship with the cleat, plug body 20 is disposed within the cut-out section between the prongs of the clip such that side surface 54 engages about a majority of the circular cross-sectional periphery (e.g., about 270°) of the plug body. In addition, the separation distance between side surfaces 53 and between portions of side surfaces 52 is smaller than the diameter of plug body 20 so as to prevent slipping and inadvertent disengagement of plug body 20 from clip 50 after a locking engagement has been achieved.

Latch clip 50 is suitably dimensioned such that prongs 56 can be inserted through receiving slot 38 and fully received within the intermediate section of socket 32. When the attachment plug of the cleat is fully inserted within the cleat receiver socket, prongs 56 of latch clip 50 are inserted into slot 38 such that the prongs engage body 20 of the cleat attachment plug. Application of sufficient force to the latch clip during such insertion results in a slight flexure of prongs 56 away from each other so as to wrap around and secure plug body 20 within the cut-out section of the prongs in a snap-tight, releasable locking relationship. Specifically, as clip 50 is inserted through receiving slot 38, angled side wall surfaces 52 of prongs 56 contact the peripheral surface of plug body 20 within the intermediate section of socket 32, forcing the prongs to slightly expand away from each other. Further movement of clip 50 laterally with respect to cleat receiver 30 and into the intermediate section of socket 32 results in a sliding movement of side wall surfaces 52 and then side wall surfaces 53 of prongs 56 along opposing outer peripheral portions of plug body 20. Once side wall surfaces 53 slide beyond plug body 20, the plug body is fully received within the cut-out section of clip 50. At this point, prongs 56 resiliently snap back toward each other, resulting in a locking engagement of the latch clip around the plug body.

Thus, when the latch clip is secured in receiving slot 38 and about plug body 20 of the cleat in this manner, axial movement of cleat 12 with respect to cleat receiver 30 is effectively limited. In addition, due to the locking relationship between the latch clip and the plug body of the cleat, the latch clip is prevented from inadvertent lateral movement with respect to the cleat and the cleat receiver. However, latch clip 50 can be disengaged from plug body 20 by applying sufficient force to pull the latch clip from the receiving slot, which in turn forces prongs 56 to move slightly away from each other as the prongs move along the periphery of the plug body until becoming disengaged.

Latch clip 50 further includes a raised portion 57 extending transversely from the base portion of the clip (i.e., at the end of the clip that opposes the prong ends). Raised portion 57 includes an outer side wall surface 59 that extends the width of clip base portion and is preferably curved in a convex configuration to generally correspond with the outer peripheral contour of cylindrical section 43 of the cleat receiver. Raised portion 57 further includes an inner side wall surface 61 (FIG. 6) that is preferably curved in a concave manner that corresponds with the curvature of opposing outer side wall surface 59. The inner side wall surface of the latch clip raised portion provides a gripping surface for a finger or prying tool to grasp and pull the latch clip from the cleat receiver socket.

The dimensions of the latch clip, including its overall major dimension and the dimensions of raised portion 57, are preferably selected such that, when the latch clip is fully received within socket 32 and is in a locking relationship with plug body 20 of cleat 12, outer side wall surface 59 of the latch clip raised portion 57 is substantially flush and continuous with the outer peripheral surface of the cylindrical section 43 of cleat receiver base portion 42 and also substantially fills the spaced defined by slot 38. However, the space defined by notch 40 remains open when the latch clip is fully inserted to facilitate insertion of a finger or other prying tool through notch 40 to engage raised portion 57 for disengaging the clip from the plug body of the cleat. In addition, the axial dimension of the cleat plug body, the thickness of the prongs and other portions of the latch clip, and the dimensions of the latch clip receiving slot are all preferably selected such that axial movement of the cleat with respect to the cleat receiver is substantially prevented when the cleat is secured by the latch clip within the cleat receiver.

The cleat receiver may further include interior wall sections 63 (FIG. 1) that are inset within clip receiving slot 38 and are curved to complement the contour of inner side wall surface 61 of the latch clip raised portion. Wall sections 63 are inset within slot 38 a sufficient distance from the outer peripheral wall surface of cylindrical section 43 to facilitate engagement with portions of wall surface 61 of the latch clip raised portion when the latch clip is inserted into slot 38 and locked with attachment plug body 20. The portion of slot 38 that lies below and is in direct communication with notch 40 does not include a wall section 63; rather, this slot portion remains exposed to provide access for a finger or other prying tool to grip inner side wall surface 61 when it is desired to disengage the latch clip from the locked position.

Operation of the quick release shoe cleat assembly 10 is now described with reference to FIGS. 1–7. Initially, a cleat 12 is selected for insertion in socket 32 of cleat receiver 30, where cleat receiver 30 is secured within the sole 26 of a shoe 28. Cleat 12 is positioned so that attachment plug 16 faces end surface 46 of cleat receiver base portion cylindrical section 43. The attachment plug is fully inserted within the cleat receiver socket such that plug retention ring 18 engages or mates with retention ring receiver socket portion 34, plug body 20 is disposed within the intermediate section of the socket, and anti-rotation body 22 engages or mates with anti-rotation receiver portion 36. Once the attachment plug is fully received within the cleat receiver socket, the cleat is prevented from rotational and lateral (i.e., side-to-side) movements with respect to the cleat receiver. However, the cleat may still be axially displaced from the cleat socket until latch clip 50 is secured to the cleat attachment plug.

Once the cleat attachment plug is fully inserted into the cleat receiver socket, latch clip 50 is aligned with its prongs 56 facing receiving slot 38. The prongs are inserted through slot 38 and a sufficient force is applied to the latch clip to force the prongs to laterally engage, expand around and lock with plug body 20 as described above. Upon complete insertion of the latch clip into the socket so as to fully engage the clip prongs with the cylindrical body of the cleat attachment plug, the cleat is effectively locked and thus limited or substantially prevented from axially, rotationally and laterally moving with respect to the cleat receiver and shoe sole. In this locked configuration, outer side wall surface 59 of latch clip 50 is preferably continuous and blends with the outer peripheral contour of cleat receiver base portion cylindrical section 43. The cleat is now ready for use with the shoe to which it is attached.

When it is desired to remove cleat 12 from shoe 28, latch clip 50 must be disengaged from cleat attachment plug body 20 by applying a sufficient force to the clip to expand and move prongs 56 laterally along the plug body and then from socket 32 via receiving slot 38. Sufficient force can be applied to clip 50 at raised portion 57, e.g., by inserting a finger or other prying tool into notch 40, so as to engage inner side wall surface 61. The latch clip can then be pulled from the cleat receiver to disengage the prongs from the cleat attachment plug, thus permitting the cleat to be removed from the socket.

In effect, the latch clip provides a lateral locking engagement with the cleat attachment plug to effectively and rigidly secure the cleat to the cleat receiver, preventing inadvertent rotational, lateral and axial movements of the cleat with respect to the shoe during use. Unlike other conventional shoe cleat attachment assemblies, such as cleat assemblies that utilize a threaded attachment design to screw the cleat to the shoe sole, the cleat assembly of the present invention maintains a rigid attachment and prevents undesired loosening of the cleat with respect to the shoe throughout the use of the cleat with the shoe.

While FIGS. 1–7 show one embodiment for realizing a shoe cleat assembly of the present invention, it should be apparent to those skilled in the art that there are a number of other embodiments that also incorporate the inventive concepts encompassed within the present invention. Some additional embodiments are illustrated in FIGS. 8–13.

Figure 8:
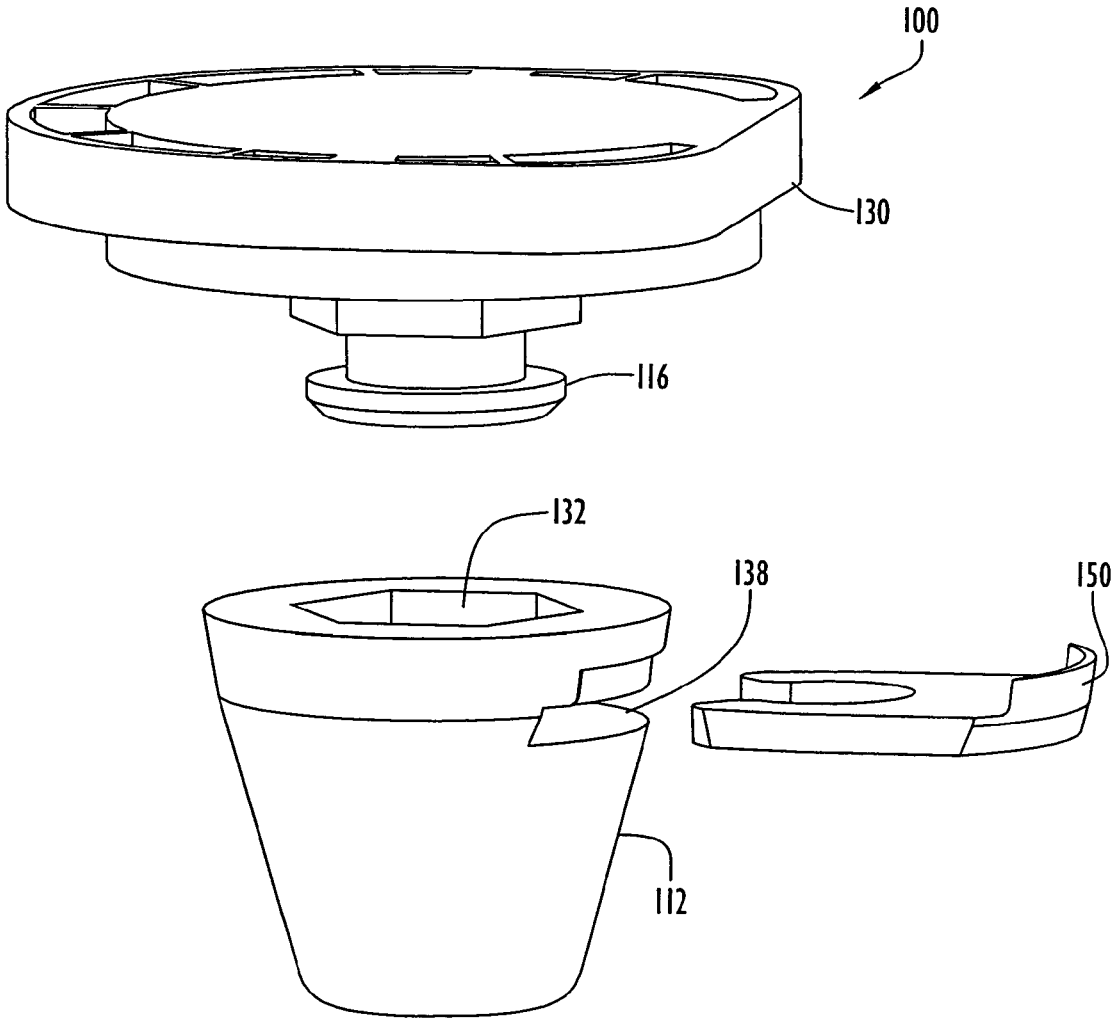
FIG. 8 is an exploded view in perspective of a second embodiment of the present invention.

In the cleat assembly 100 depicted in FIG. 8, the location of attachment plug 116 and socket 132 are reversed in comparison to the previous embodiment described above and depicted in FIGS. 1–7. In particular, attachment plug 116 is formed as part of the cleat receiver 130 and socket 132 is preformed within cleat 112. In addition, latch pin 150 is inserted into receiving slot 138 disposed on cleat 112 to secure the cleat to the cleat receiver.

Figure 9:
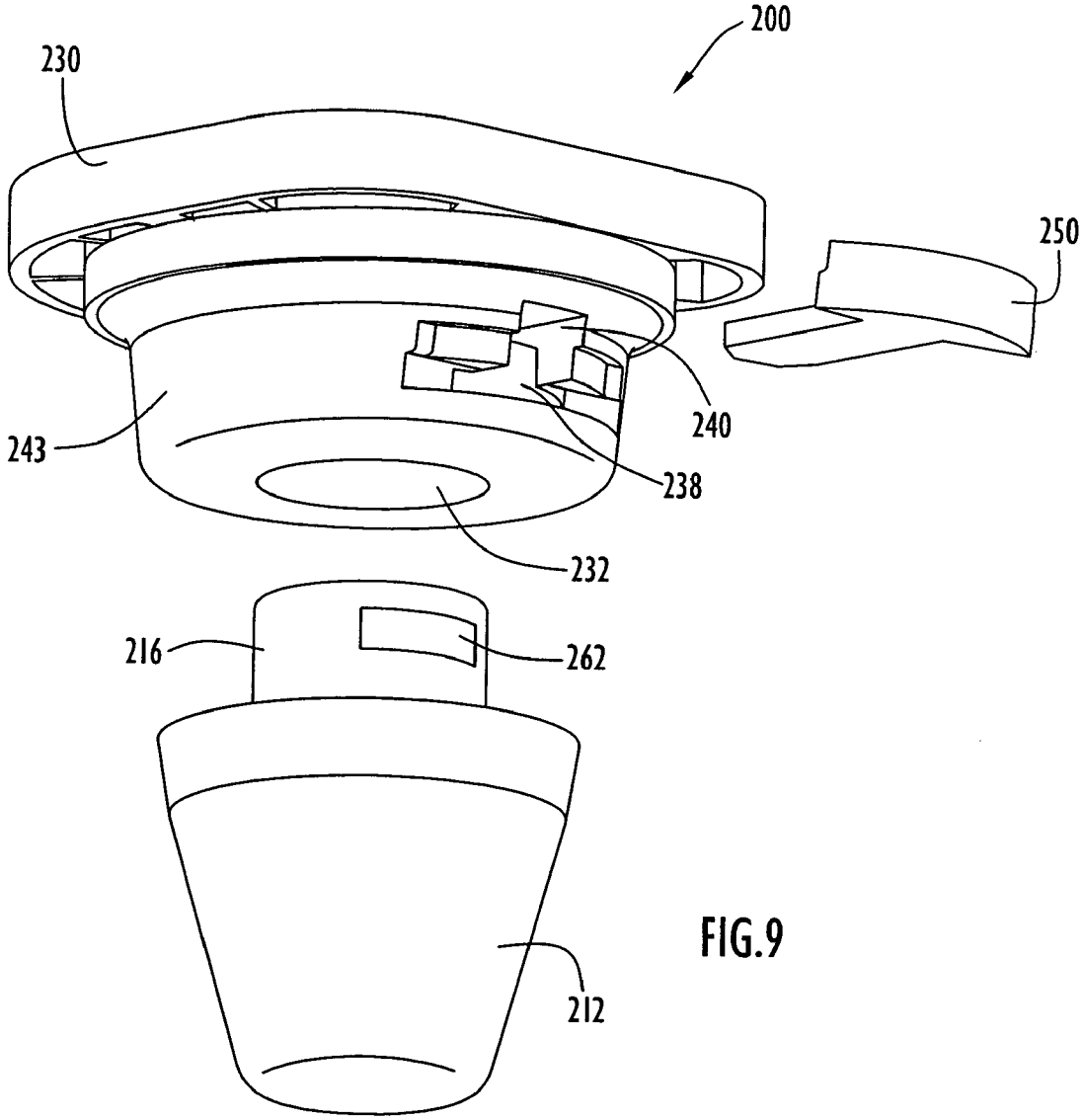
FIG. 9 is an exploded view in perspective of a third embodiment of the present invention.

In the embodiment of FIG. 9, cleat assembly 200 includes a cleat 212 having a generally cylindrical attachment plug 216 with a single rectangular slot 262 disposed along a peripheral side wall portion of the plug. Cleat receiver 230 includes a hollow cylindrical section 243 with a socket 232 dimensioned to receive and retain plug 216. A latch clip receiving slot 238 with notch 240 is disposed along the peripheral side wall of cylindrical section 243. A generally T-shaped latch pin 250 is utilized to secure the cleat to the cleat receiver. Attachment plug 216 of cleat 212 is inserted into socket 232 so that cleat slot 262 is aligned with clip receiving slot 238, and then the elongated portion of T-shaped latch pin 250 is inserted into both slots 238 and 262 to axially, rotationally and laterally secure the cleat to the cleat receiver. Optionally, cleat slot 262 may extend entirely through attachment plug 216, the cleat receiver may include a pair of receiving slots 238 aligned at opposing peripheral surface locations on cylindrical section 243, and latch pin 250 may be sufficiently dimensioned to permit the latch pin to extend completely through the attachment plug and be anchored at both receiving slots so as to further secure the cleat to the cleat receiver.

Figures 10A, 10B:
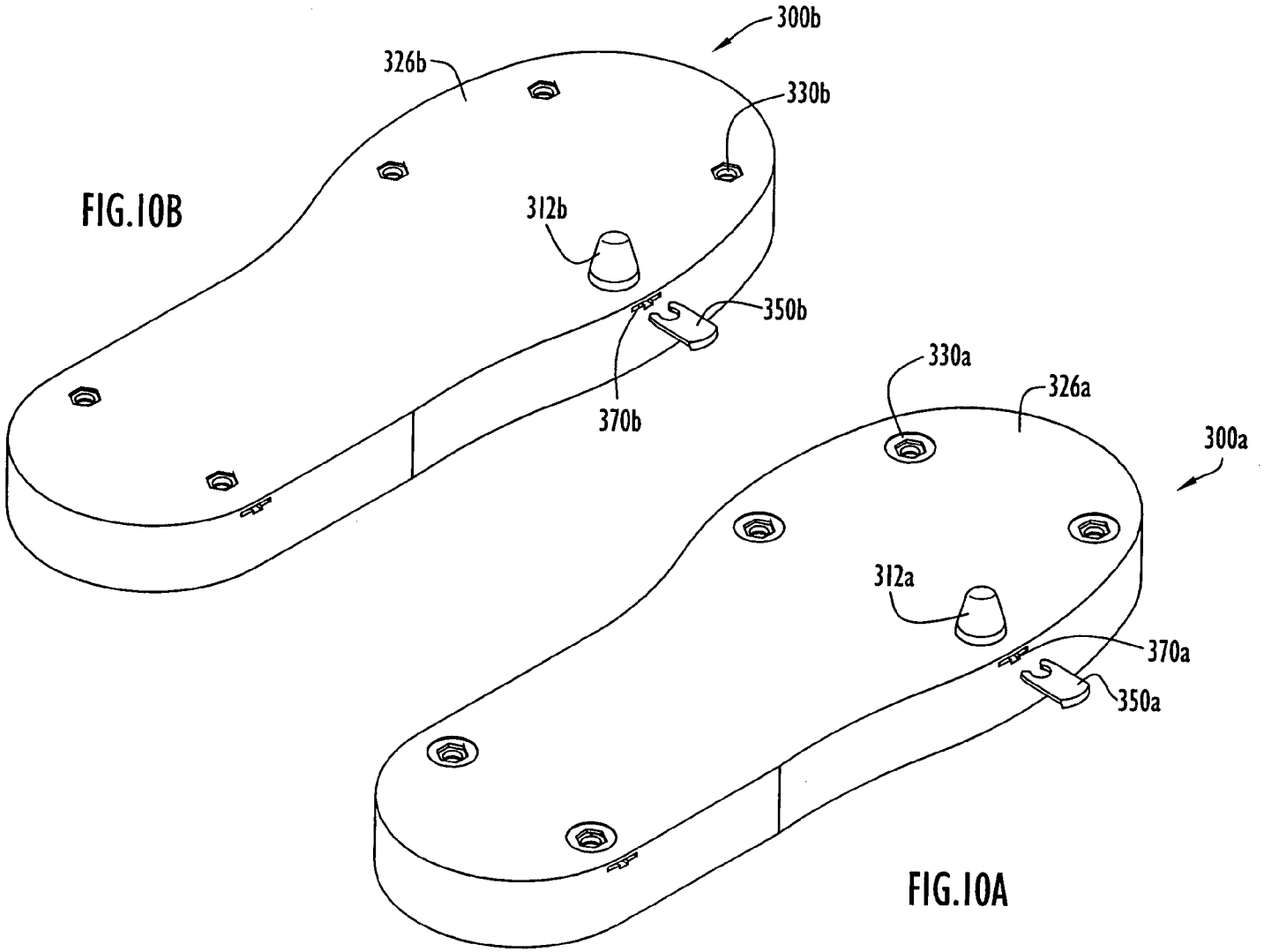
FIGS. 10*a* and 10*b* are views in perspective of additional embodiments of the invention showing a shoe wherein the cleat receptacles are embedded in the outer soles of the shoe.

FIGS. 10A and 10B disclose additional embodiments of a cleat assembly 300, wherein cleat receivers 330 are imbedded within outer shoe sole 326. In the embodiment of FIG. 10A, cleat receiver 330*a* is a separated component embedded within the outer shoe sole. In contrast, cleat receiver 330*b* in FIG. 10B is formed as an integral part of the outer shoe sole (i.e., the shoe sole forms a part of the cleat assembly). Outer shoe sole 326 also includes preformed clip receiving slots 370 extending from an outer peripheral side surface of the shoe sole and in communication with respective receiver sockets of the cleat receiver. Latch clips 350, which may be longer in a major dimension in comparison to the latch clips of the embodiment described above and depicted in FIGS. 1–7, are inserted and removed from the receiving slots on the outer peripheral side surface of the shoe sole to effect locking and disengagement of cleats 312 to the cleat receivers.

Figure 11A:
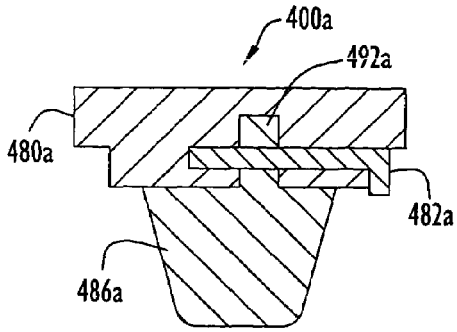
FIGS. 11*a*–11*f* are detailed cross-sectional side views of respective cleat attachment arrangements representing further embodiments of the invention.
Figure 11B:
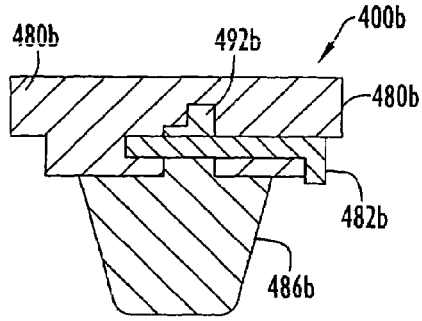
Figure 11C:
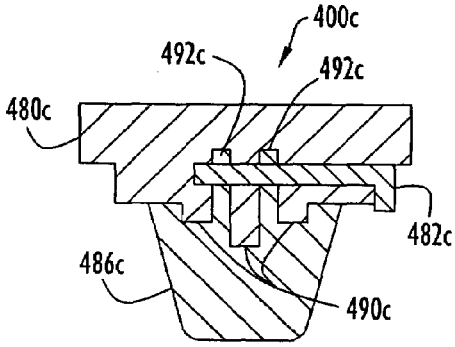
Figure 11D:
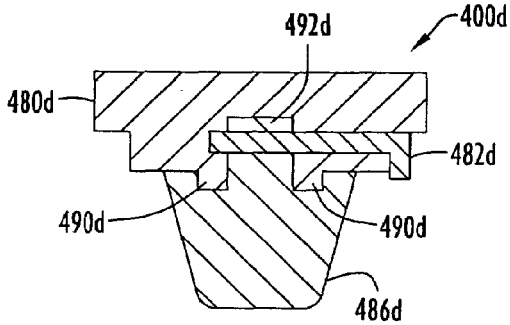
Figure 11E:
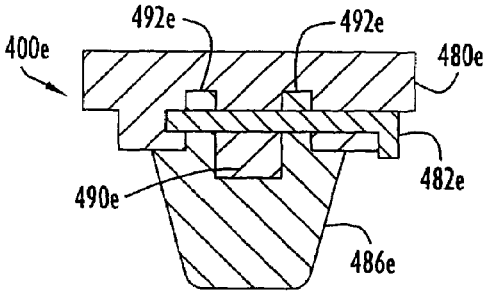
Figure 11F:
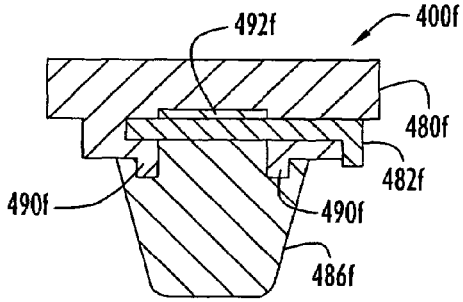

FIGS. 11A–11F disclose still further embodiments of cleat assemblies 400 which include two or more complementary sockets and/or plugs disposed within the cleat and receiver that facilitate a locking relationship when the cleat and receiver are engaged. In each of these embodiments, cleat receivers 480 are configured for complementary connection with a cleat 486. In the embodiments of FIGS. 11A and 11B, cleat receivers 480 include sockets to receive complementary plug portions 492. In the remaining embodiments of FIGS. 11C–11F, the cleat receivers 480 each include at least one plug portion 490 that is aligned to correspond with at least one corresponding plug portion 492 disposed on the cleats 486, and each of the cleats and the cleat receivers further include socket portions to receive the corresponding plug portions of the other component when the cleats are engaged in a mating and locking relationship with the cleat receivers. Each of these embodiments further includes a latch pin 482 that is inserted through a peripheral receiving slot of receiver 480, and the plug portions 490 and/or 492 each include corresponding slots that are suitably aligned and configured to receive latch pin 482 so as to limit or substantially prevent rotational, lateral and axial movements of the cleat with respect to the receiver when the latch pin is engaged in a locking relationship with the cleat and the receiver. While a variety of different embodiments are depicted in FIGS. 11A–11F, it is to be understood that these embodiments are not limiting but are merely illustrative of the inventive concept of combining corresponding and complementary plug and socket portions in each of the cleat and the receiver to facilitate a releasable locking relationship between the cleat and receiver.

Figure 12:
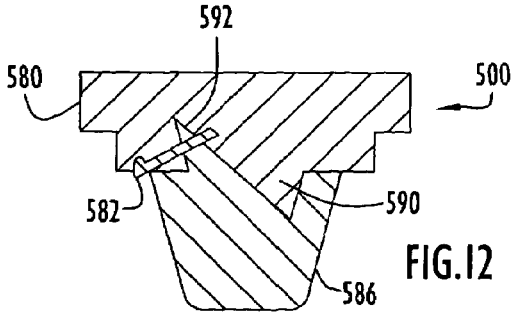
FIG. 12 is a detailed cross-sectional view of a cleat attachment arrangement representing yet another embodiment of the invention.

Further, it is noted that the sockets and plugs need not be substantially oriented in a vertical direction (i.e., a direction that is substantially perpendicular with the sole of the shoe to which the receiver is attached). Rather, the sockets and plugs can be oriented at selected angles from the vertical such as in the embodiment depicted in FIG. 12. In particular, cleat assembly 500 in FIG. 12 includes a receiver 580 and a cleat 586. The receiver includes a pointed prong 590 and an angled socket adjacent prong 590 that is suitably dimensioned and configured to receive a complementary pointed prong 592 extending from cleat 586. The cleat further includes a complementary socket to receive prong 590 when the cleat and receiver are engaged in a mating relationship as depicted in FIG. 12. A latch pin 582 is inserted at an angle through a receiving slot located on an end surface of receiver 580 and engages with a complementary slot extending through prong 592 of cleat 586 to secure the cleat and limit or substantially prevent its rotational, lateral and axial movement with respect to the receiver.

It will be appreciated that the embodiments described above and illustrated in the drawings represent only a few of the many ways of implementing a quick release shoe cleat and corresponding methods associated with the shoe cleat.

The cleat receiver, cleat and latch clip or pin may be constructed of any suitable materials and have any suitable dimensions. The cleat receiver may be separable from a shoe sole, molded or bonded in any suitable manner with a shoe sole, or integrally formed as part of the shoe sole. The cleat receiver, cleat and latch clip or pin may include any type of corresponding engaging elements that are combinable to releasably lock the cleat to the cleat receiver and limit or substantially prevent rotational, lateral and axial movements of the cleat with respect to the cleat receiver. The engaging elements may be any combination of one or more plug and socket arrangements disposed on the cleat receiver and cleat, with one or more suitable access slots to facilitate insertion and removal of the latch clip or pin.

The cleat may include any number of cleat elements (e.g., one, two or more cleat elements) having any selected geometric configurations and oriented in any selected arrangement (e.g., symmetrical or asymmetrical) with respect to each other and the cleat. In addition, the cleat may include a base section having a first surface to which one or more cleat elements are secured, where the base section further includes a second surface opposing the first surface to which one or more cleat receiver engaging elements (e.g., an attachment plug) are secured.

The cleat may further be indexable with respect to the cleat receiver, and thus the shoe sole. For example, certain embodiments, such as those depicted in FIGS. 9 and 11–12, may require a specific orientation of the cleat with respect to the cleat receiver in order to obtain a locking engagement between the cleat, receiver and latch pin or clip. In addition, in embodiments such as those depicted in FIGS. 1–8 and 10, there are many ways in which to render the cleat indexable. For example, the cleat elements of the cleat receiver and/or the base may be eccentrically aligned with respect to the engaging elements secured to the base of the cleat. Alternatively, in the embodiment of FIGS. 1–7, the anti-rotation body of the cleat attachment plug and the anti-rotation receiver portion of the receiver socket may be modified to include irregular and/or asymmetric configurations. Such a modification will limit the orientation of the cleat with respect to the receiver to a select number (e.g., one) of orientations that will permit the attachment plug to be fully inserted into the receiver socket.

The cleat and cleat receiver may include engaging sections with any suitable number and types of plug or prong portions and complementary receiving socket or slot portions to facilitate mating of the engaging sections with respect to each other prior to locking the cleat to the receiver with the latch clip or pin. As depicted in some of the previous examples, the cleat may include a single plug attachment member or socket that is suitably dimensioned to mate with a corresponding socket or plug attachment member of the cleat receiver. Alternatively, as depicted in some of the other embodiments, the cleat may include two or more plug and socket members that engage in a mating relationship with complementary plug and socket members of the cleat receiver.

The latch clip or pin may have any suitable configuration that facilitates a locking engagement with the cleat and the cleat receiver to limit or substantially prevent axial, lateral and rotational movements of the cleat with respect to the receiver. The latch clip or pin may include any suitable structural components that provide a gripping surface to allow a user to remove the latch clip or pin from the locking relationship. For example, as an alternative or in addition to the features noted above for the latch clip raised surface, the latch clip or pin may include any suitable indentations or protrusions to enhance gripping of the latch clip or pin during its disengagement from the cleat and the cleat receiver.

Having described preferred embodiments of a quick release shoe cleat and corresponding methods, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A shoe cleat assembly comprising:

a cleat receiver including a cleat engaging section;

a cleat including a receiver engaging section suitably dimensioned and configured to releasably engage with the cleat receiver; and a latch member suitably dimensioned and configured to releasably engage with portions of the cleat engaging section and the receiver engaging section;

wherein, upon engagement of the cleat engaging section, the receiver engaging section and the latch member with each other, the cleat is releasably secured to the cleat receiver wherein:

one of the cleat engaging section of the cleat receiver and the receiver engaging section of the cleat includes an axially extending socket and a latch receiving slot disposed along a peripheral side wall surface of the cleat receiver or the cleat, the latch receiving slot being in communication with the socket;

the other of the cleat engaging section of the cleat receiver and the receiver engaging section of the cleat includes an axially extending attachment plug dimensioned to be received within the socket of the cleat receiver; and the cleat is releasably secured to the cleat receiver by inserting the attachment plug into the socket and inserting the latch member through the latch receiving slot and into the socket so as to releasably engage the latch member with the attachment plug.

2. The shoe cleat assembly of claim 1, wherein the socket includes an anti-rotation section having a geometric configuration that corresponds with a geometric configuration of an anti-rotation section of the attachment plug such that, upon insertion of the attachment plug within the socket, the anti-rotation sections of the cleat and the cleat receiver are aligned and mate with each other to prevent rotational movements of the cleat with respect to the cleat receiver.

3. The cleat assembly of claim 2, wherein each of the anti-rotation sections of the socket and the attachment plug has a hexagonal configuration.

4. The cleat assembly of claim 1, wherein the latch member includes a clip with a pair of prongs spaced apart from each other, and the attachment plug includes a plug body section that fits and is releasably locked between the prongs when the attachment plug is inserted into the socket and the latch member is inserted through the latch receiving slot and into the socket.

5. The cleat assembly of claim 1, wherein the attachment plug includes a ring section that mates with a complementary ring receiving section of the socket when the attachment plug is inserted into the socket.

6. The cleat assembly of claim 1, wherein the attachment plug includes a slot extending at least partially through the attachment plug, and the latch member includes a pin that extends into the slot of the attachment plug when the attachment plug is inserted into the socket and the latch member is inserted through the latch receiving slot and into the socket.

7. The cleat assembly of claim 1, wherein the cleat or the cleat receiver includes a notch disposed along the peripheral side wall surface adjacent the latch receiving slot, and the latch member includes a raised section with a gripping surface that is accessible via the notch to facilitate removal of the latch member from engagement with the attachment plug.

8. A shoe with integral cleat assembly comprising:

a shoe sole; and a cleat assembly secured within the shoe sole, the cleat assembly comprising:

a cleat receiver including a cleat engaging section;

a cleat including a receiver engaging section suitably dimensioned and configured to releasably engage with the cleat receiver; and a latch member suitably dimensioned and configured to releasably engage with portions of the cleat engaging section and the receiver engaging section;

wherein, upon engagement of the cleat engaging section, the receiver engaging section and the latch member with each other, the cleat is releasably secured to the cleat receiver, wherein:

one of the cleat engaging section of the cleat receiver and the receiver engaging section of the cleat includes an axially extending socket and a latch receiving slot disposed along a peripheral side wall surface of the cleat receiver or the cleat, the latch receiving slot being in communication with the socket;

the other of the cleat engaging section of the cleat receiver and the receiver engaging section of the cleat includes an axially extending attachment plug dimensioned to be received within the socket of the cleat receiver; and the cleat is releasably secured to the cleat receiver by inserting the attachment plug into the socket and inserting the latch member through the latch receiving slot and into the socket so as to engage the latch member with the attachment plug.

9. A method of attaching a cleat to a cleat receiver secured to a shoe sole comprising:

(a) engaging an engaging section of the cleat receiver with an engaging section of the cleat; and (b) inserting a latch member through portions of the engaging sections of the cleat and the cleat receiver to releasably secure the cleat to the cleat receiver, wherein one of the cleat engaging section of the cleat receiver and the receiver engaging section of the cleat includes an axially extending socket and a latch receiving slot disposed along a peripheral side wall surface of the cleat receiver or the cleat, the latch receiving slot being in communication with the socket, the other of the cleat engaging section of the cleat receiver and the receiver engaging section of the cleat includes an axially extending attachment plug dimensioned to be received within the socket of the cleat receiver, and:

(a) includes:

(a.1) inserting the attachment plug into the socket; and (b) includes:

(b.1) inserting the latch member through the latch receiving slot and into the socket to releasably engage the latch member with the attachment plug.

10. The method of claim 9, wherein the socket includes an anti-rotation section having a geometric configuration that corresponds with a geometric configuration of an anti-rotation section of the attachment plug such that, upon insertion of the attachment plug within the socket, the anti-rotation sections of the cleat and the cleat receiver are aligned and mate with each other to prevent rotational movements of the cleat with respect to the cleat receiver.

11. The method of claim 10, wherein each of the anti-rotation sections of the socket and the attachment plug has a hexagonal configuration.

12. The method of claim 9, wherein the latch member includes a clip with a pair of prongs spaced apart from each other, and the attachment plug includes a plug body section that fits and is releasably locked between the prongs of the clip when the latch member is inserted through the latch receiving slot and into the socket.

13. The method of claim 9, wherein the attachment plug includes a ring section that mates with a complementary ring receiving section of the socket when the attachment plug is inserted into the socket.

14. The method of claim 9, wherein the attachment plug includes a slot extending at least partially through the attachment plug, and the latch member includes a pin that extends into the slot of the attachment plug when the attachment plug is inserted into the socket and the latch member is inserted through the latch receiving slot and into the socket.

15. The method of claim 9, further comprising:

(c) removing the latch member from the portions of the engaging sections of the cleat and the cleat receiver to facilitate removal of the cleat from the receiver, wherein the cleat or the cleat receiver includes a notch disposed along the peripheral side wall surface adjacent the latch receiving slot, the latch member includes a raised section, and (c) includes:

(c.1) extending a prying tool through the notch to grip a surface of the raised section of the latch member; and (c.2) pulling the latch member with the prying tool to remove the latch member from the portions of the engaging sections of the cleat and the cleat receiver.

* * * * *